US007967484B2

(12) United States Patent
Lederer

(10) Patent No.: US 7,967,484 B2
(45) **Date of Patent: *Jun. 28, 2011**

(54) CUSTOMIZED ELECTRONIC CANDLE

(76) Inventor: Gabor Lederer, Clifton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/512,545

(22) Filed: Jul. 30, 2009

(65) Prior Publication Data

US 2009/0310374 A1 Dec. 17, 2009

Related U.S. Application Data

(62) Division of application No. 11/846,946, filed on Aug. 29, 2007, now Pat. No. 7,695,171.

(51) Int. Cl.
*F21V 21/00* (2006.01)
*F21V 33/00* (2006.01)

(52) U.S. Cl. ..... 362/392; 362/190; 362/295

(58) Field of Classification Search ..... 362/157, 362/161, 203, 392, 810, 190, 191, 295, 311.01
See application file for complete search history.

(56) References Cited

U.S. PATENT DOCUMENTS 6,800,167 B1 * 10/2004 Frazer ..... 156/249
7,671,751 B2 * 3/2010 Russell et al. ..... 340/573.3
7,695,171 B2 * 4/2010 Lederer ..... 362/392
2007/0230189 A1 10/2007 Gruenbacher et al.

* cited by examiner

*Primary Examiner* — John A Ward
(74) *Attorney, Agent, or Firm* — Israel Nissenbaum

(57) ABSTRACT

A system for the customization of an electronic candle, which system includes an electronic candle assembly comprising an illumination element and means for illuminating the illumination element for providing a simulated illuminated wax candle effect, a first sleeve having a translucent portion and first customizing indicia, a second sleeve having a translucent portion and second customizing indicia, a second indicia being visually distinguishable from the first indicia, the assembly and each sleeve has cooperable constructions for selective assembly of each sleeve to the electronic candle assembly for customizing the alternative electronic candle.

32 Claims, 11 Drawing Sheets

CUSTOMIZED ELECTRONIC CANDLE

PRIOR RELATED APPLICATIONS

This application is a divisional application of and claims priority to application Ser. No. 11/846,946, filed Aug. 29, 2007 now U.S. Pat. No. 7,695,171, which claims priority to application Ser. No. 10/666,731, filed Mar. 11, 2003, now U.S. Pat. No. 7,011,426 granted Mar. 14, 2006, and to Ser. No. 11/254,428, filed Oct. 20, 2005, which applications and patent are incorporated herein in their entireties by reference thereto.

BACKGROUND OF THE INVENTION

1. Field of Invention

This invention relates to electronic candles. This invention also relates to customizing or personalizing electronic candles. This invention further relates to memorial and funerary business methods.

2. Background and Discussion of the Prior Art

Electronic candle constructions are generally known. Electronic candle constructions are shown and described in U.S. Pat. No. 5,863,108 to Lederer, U.S. Pat. No. 6,066,924 to Lederer, U.S. Pat. No. 7,011,426 to Lederer and US Publication No. 2005/0179355 to Lederer. It is also presently known to commercialize electronic candles for religious institutions and memorial business as disclosed in US Publication No. 2006/0039137 to Lederer.

It is also known to provide LED illuminated signs with an etched portion to scatter light as disclosed in US Publication No. 2005/0188569 to Derose.

In the art directed to funerary and memorial business, there is a growing present need to provide services to a diverse customer base of different religions and further having diverse personalized memorial needs. The funerary and memorial business therefore desires a readily operable and cost effective system that services the diverse customer base and their concomitant needs.

The present invention provides an electronic candle assembly and system that resolves the foregoing art needs. The present invention provides an electronic candle assembly and system as aforesaid which is readily operable in a commercially practicable manner.

SUMMARY OF THE INVENTION

The present system for the customization and personalization of an electronic candle includes an electronic candle assembly having a base and interchangeable candle cover sleeves. The candle cover sleeves are alternatively mounted to the base. Each candle cover sleeve has different or distinguishing indicia, e.g., Cross, Star of David, and the like, or it can have none of it, and various compartments for customization for or by a specific customer. The base contains illumination elements and their power and driving circuitries. The illuminations may be in color complementary to a respective candle cover sleeve color to provide an enhanced simulated wax candle flickering effect. The Star of David candle cover sleeve may appropriately be blue, and the Cross candle cover sleeve may appropriately be red.

An assembled and customized candle cover sleeve may include in its lowered and slanted top a picture, or in its enclosable readily viewable space or compartment a memento of particular significance to the deceased and to the customer or viewer or it may house both. The candle cover sleeve further includes an internal holder for a customized printed sheet bearing indicia to identify the deceased or it uses a slidable and interchangeable collar assembly to hold indicia on its external surface.

The electronic candle assembly includes a radially disposed specifically configured on-off switch. The switch is frictionally engaged by the inner surface of the candle cover sleeve. The user by depressing the sleeve actuates the-illuminating elements to activate the flickering wax candle simulation. The electronic candle includes circuitries and alternate power sources whereby the electronic memorial candle may in effect be lighted in perpetuity.

In one embodiment, a funeral director or customizing agent receives an email order or completed e-order form with customization instructions from the customer. The funeral director customizes and then assembles the components for ready customization of the electronic candle for delivery to the customer at or in connection with a funeral or memorial service.

DESCRIPTION OF THE INVENTION

Figure 1:
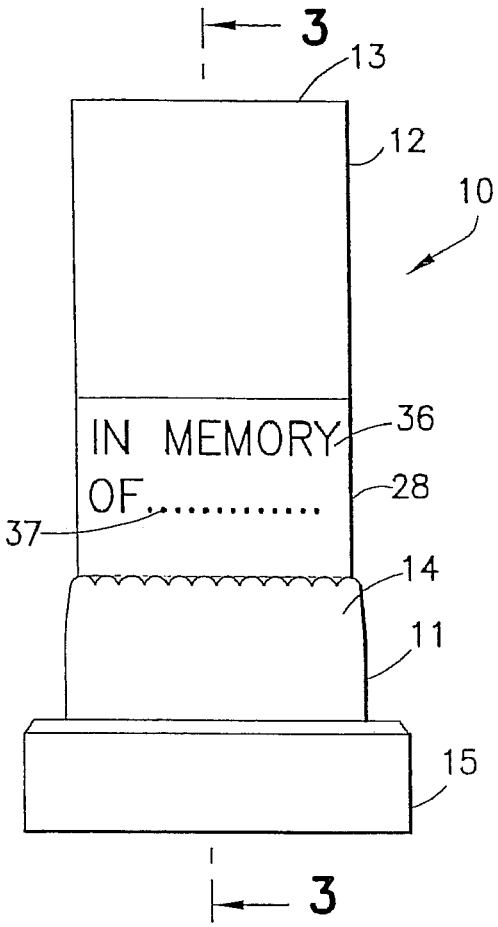
FIG. 1 is a side elevational view of one embodiment of the electronic candle of the present invention.

Referring to FIGS. 1, 2, 3, 3A-3C, 8 and 9, there is shown an embodiment of the electronic candle 10. Candle 10, generally, includes an illumination assembly 11, a slidably removable candle cover sleeve 12, a top cover assembly 13 a base 41 with 42 cylindrical arms and a cover 14. The assembly rests on pedestal 15.

Illumination assembly 11 has a housing 16, electronic assembly 17, movable switch arm 18, operably connected with electronic assembly 17, two vertically disposed illumination elements or LEDs 19, and translucent illumination housing 20, for purposes hereinafter appearing. It also has a base 41 with cylindrical arms 42 and a compression spring 40.

Candle cover sleeve 12 is cylindrically shaped. Candle cover sleeve 12 is partially clear, textured or transparent. Candle cover sleeve 12 has an outer cylindrical surface 22, an inner cylindrical surface 23, an annular top edge 24 and an annular bottom edge 25 having radially outwardly disposed lip 25*a*. A radially inwardly protruding element 30 is formed on inner cylindrical surface 23 at a prescribed distance from bottom edge 25 for purposes hereinafter appearing. Inner cylindrical surface 23 is formed with recess 26 for receiving a sheet 35 bearing indicia 36 (FIG. 1), whereby the indicia is viewable through clear portion 28. The candle cover sleeve also has a lowered and angled circular top 22A and on 22A outer surface a 22B recess to receive photo 63. A compression spring 40 is operably disposed between candle cover sleeve 12 bottom edge 25, illumination housing 16, housing base 41 and cylindrical arms 42. Spring 40 is retained between candle cover sleeve 12, lip 25A, base 40 and cylindrical arms 42. Cylindrical arms 42 also limit candle cover sleeve 12 motion when base cover 14 is placed. (FIGS. 3A-3C).

Figure 3A:
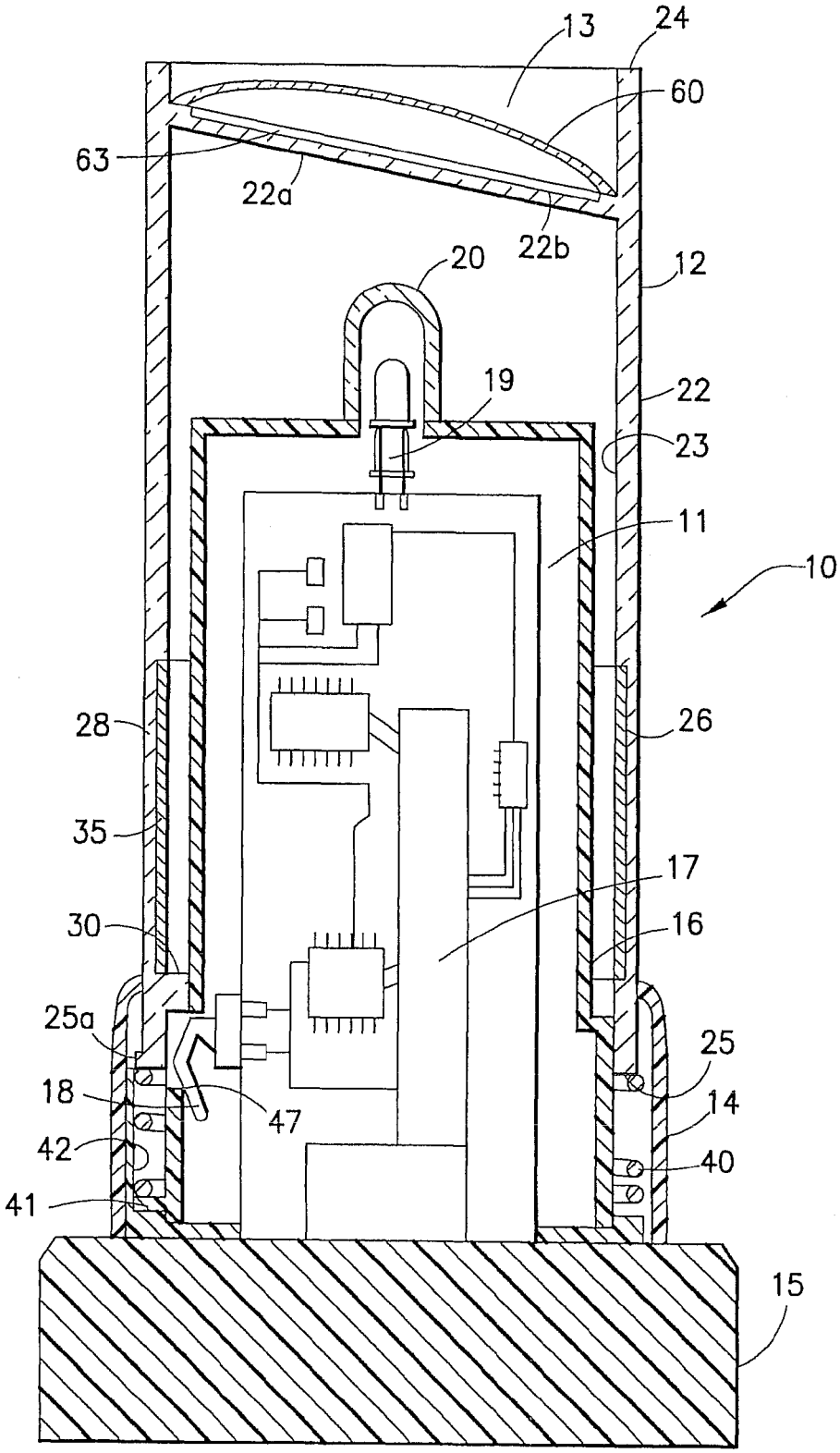
FIG. 3A is an enlarged sectional view taken along line 3-3 of FIG. 1 in the "OFF" disposition.
Figure 3B:
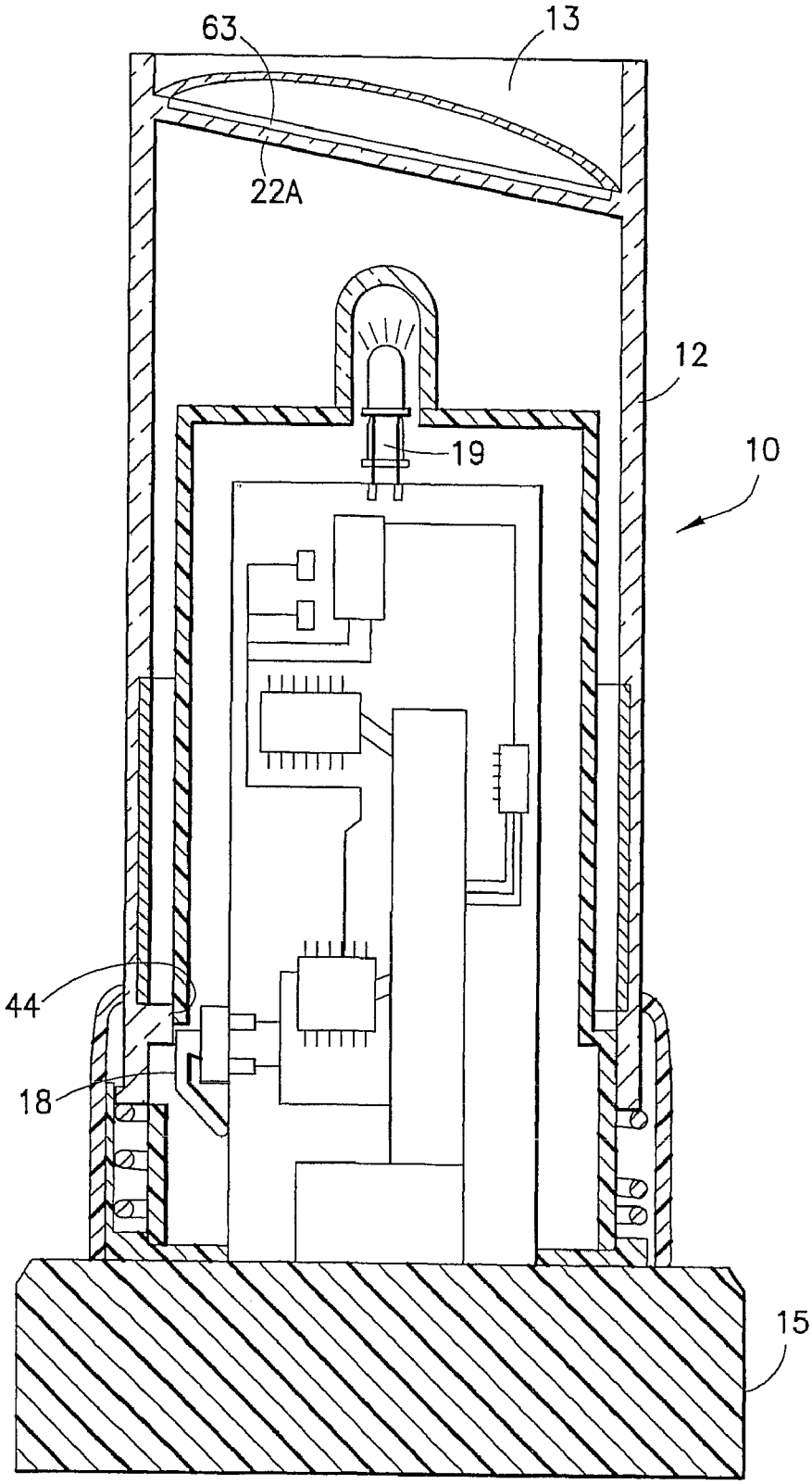
FIG. 3B is an enlarged sectional view as in FIG. 3A in the initial "ON' disposition.
Figure 3C:
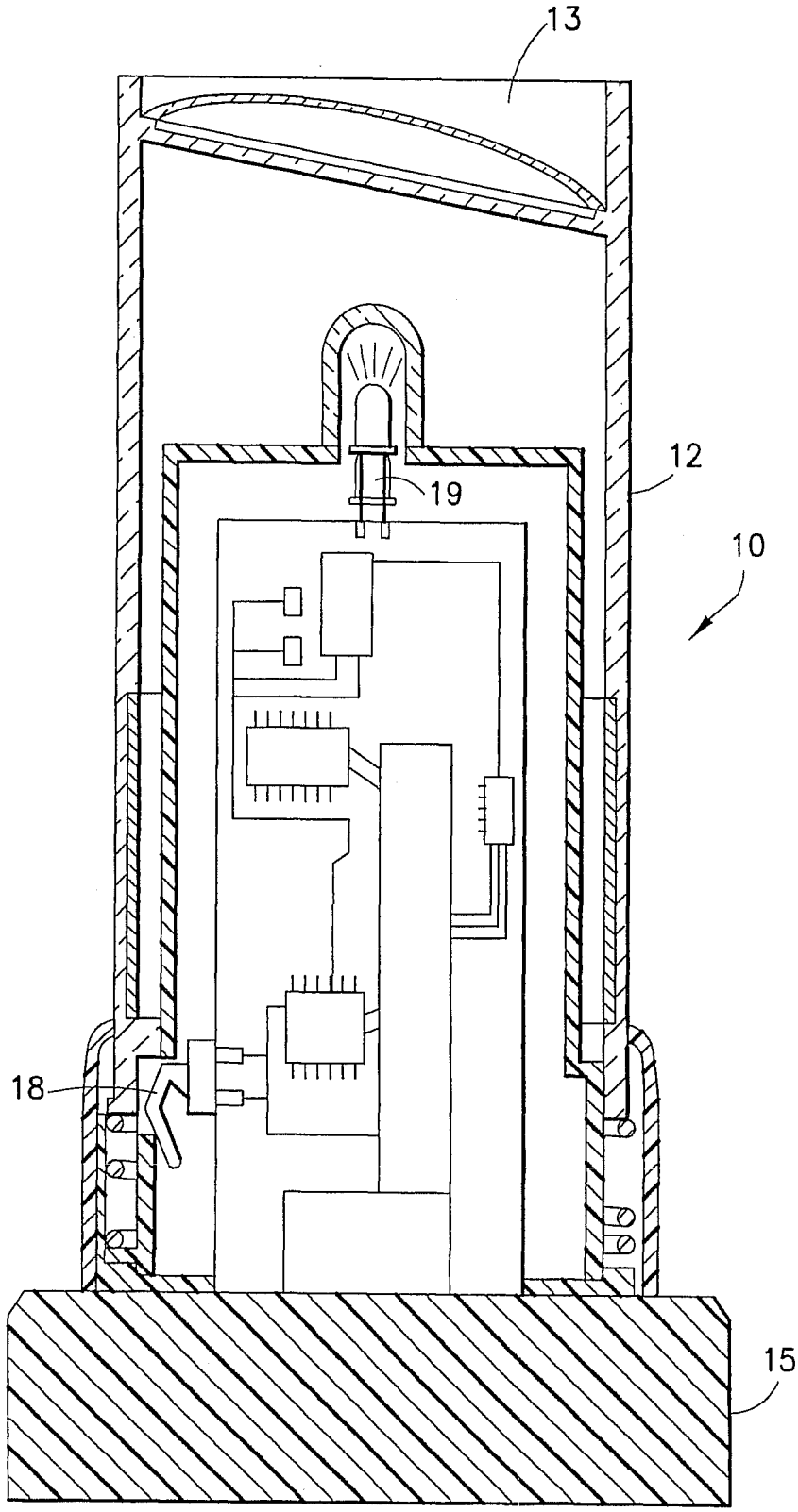
FIG. 3C is an enlarged sectional view as in FIG. 3B in the second or in perpetuity "ON" disposition.

Referring to specifically to FIGS. 3A-3C, candle cover sleeve 12 is shown in operable engagement with switch arm 18, spring 40 and illumination circuitry 17 and LEDs 19. Referring to FIG. 3A, element 30 slidably engages the outer surface of housing 16. Spring 40 is uncompressed in FIG. 3A. Sleeve bottom edge 25 and 25A rests on spring 40 in the disposition of FIG. 3A. In the foregoing manner of constructions, switch arm 18 is disposed in the initial "OFF" position.

Referring specifically now to FIG. 3B, there is shown the downward movement of candle cover sleeve 12 by the user (not shown) pressing downwardly on candle cover sleeve top edge 24. This downward movement causes the candle cover sleeve bottom edge 25A to compress spring 40. Candle cover Sleeve protruding element 30, slidably moves downwardly from the outer surface housing 16, and contactingly slidably engage switch arm 18. This engagement causes switch arm 18 to pivot inward to initiate "ON" position as shown in FIG. 3B. This downward initial movement of candle cover sleeve 12 causes switch arm 18 to actuate electronic assembly 17 to turn the illuminating LEDs 19 on.

Referring now specifically to FIG. 3C, there is shown the operating position after the user (not shown) disengages from sleeve top edge 24. Spring 40 decompresses and returns to its initial disposition. Sleeve protruding element 30 likewise returns to its initial position. Switch arm 18 likewise returns to its initial position. Circuitry 17 power holding circuitry electronics 51, however, causes LEDs 19 to remain ON for an extended period if sleeve 12 remains downwardly unmoved. Candle 10 is then effectively illuminated in perpetuity. If candle cover sleeve 12 is depressed by the user again, the switch arm 18 is moved to an inward position, and circuitry 17 power holding electronics 51 will turn the LEDs 19 OFF.

Figure 8:
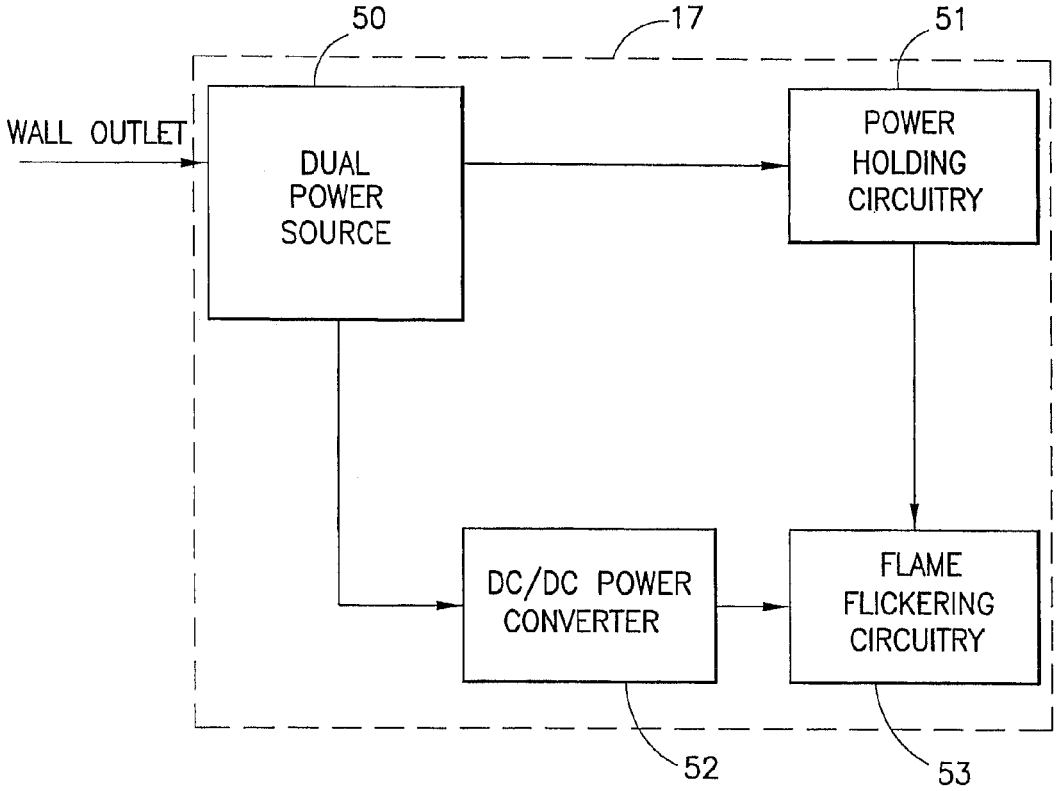
FIG. 8 is a block diagram of the power source and circuitry of the electronic candle.
Figure 9:
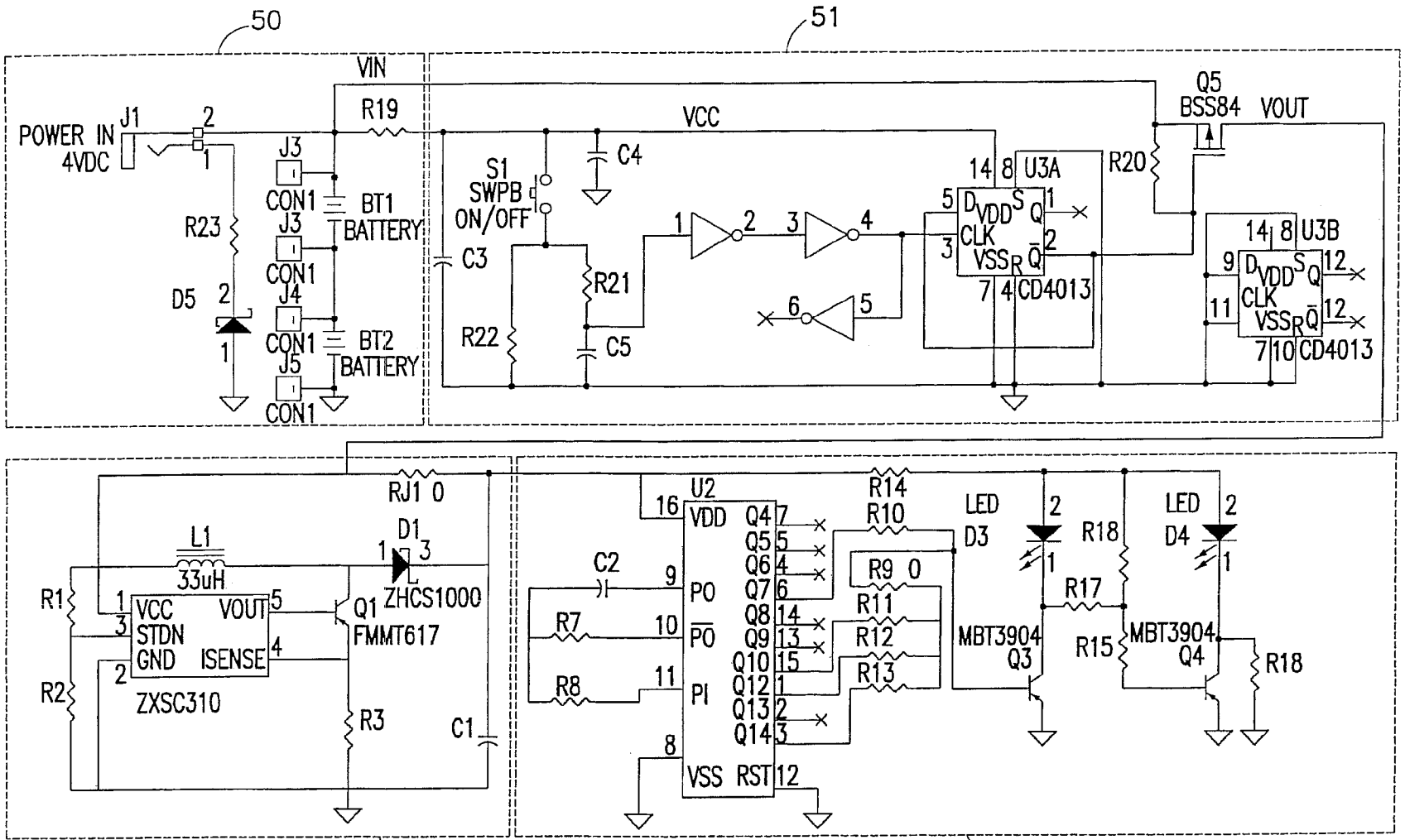
FIG. 9 is a schematic of the electronic circuitry of the electronic candle corresponding to FIG. 8.
Figure 10:
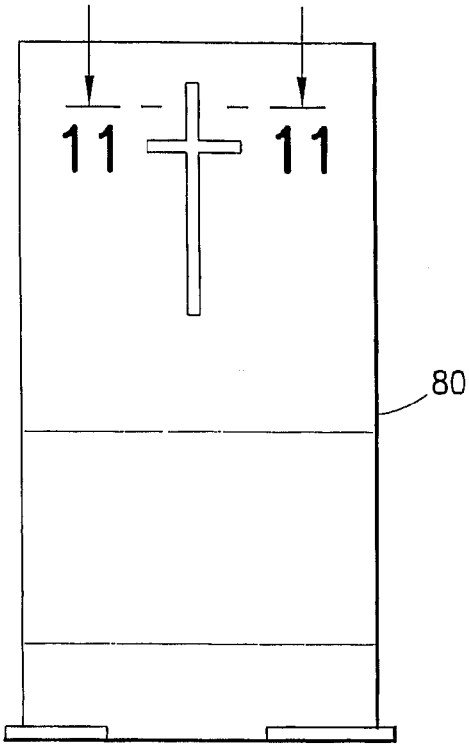
FIG. 10 is a side elevational view of a sleeve bearing a Cross.
Figure 11:
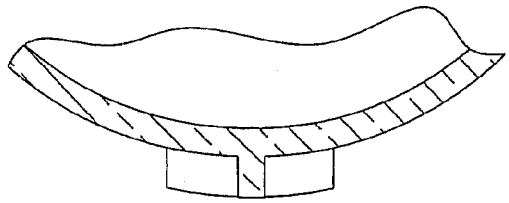
FIG. 11 is an enlarged fragmentary view taken along line 11-11 of FIG. 10.
Figure 12A:
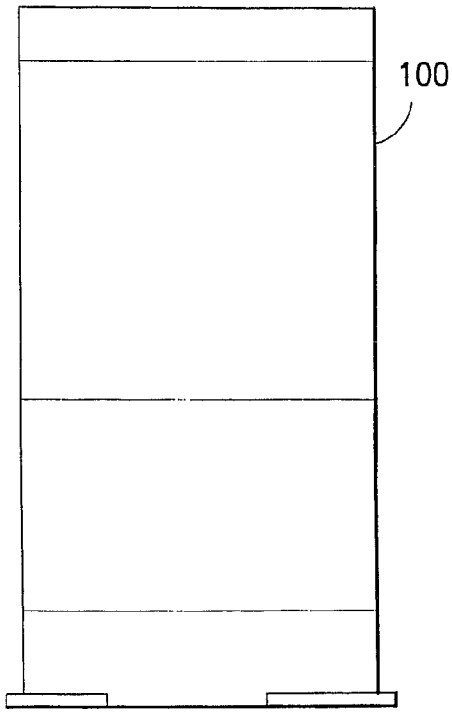
FIG. 12A is a side elevational view of a candle cover sleeve bearing no religious indicia.
Figure 12:
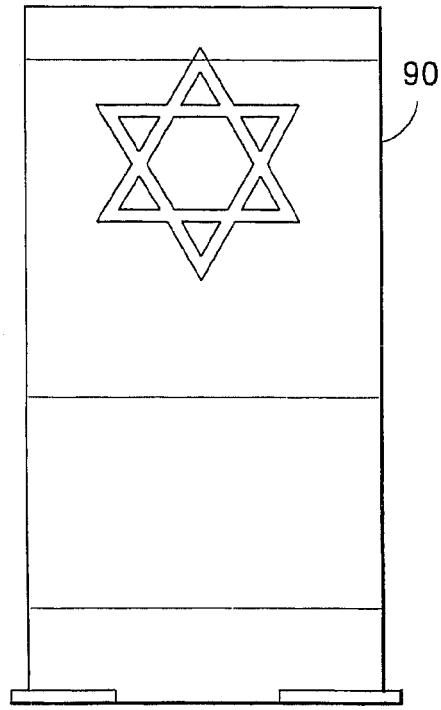
FIG. 12 is a side elevational view of a sleeve bearing a molded Star of David.

Referring specifically to FIGS. 8 and 9 there is shown a block diagram and an actual schematic of the electronic circuitries The dual power source the DC/DC power converter, and flame flickering circuitry to provide the LEDs with illumination in effect in perpetuity. The electronic assembly 17 is connected to wall outlet power supply (not shown) in a customary manner. The power supply is connected to dual power source 50, which provides power to the power holding circuitry 51 and to DC/DC power converter 52. The power source 50 provides power to simulate flame flickering circuitry 53. FIG. 9 shows an actual working circuitry.

In this manner of construction, LEDs 19 remains lighted by either the batteries or the external power source. This permits the LEDs 19 to remain lighted in perpetuity. If batteries are rechargeable types the external power source will recharge them at the same time.

Candle 10 remains lighted in perpetuity, as is the generally most desired presentation for memorial candles. Candle 10 is provided with a sheet or insert 35 which is imprinted with a memorial notice 36 once with inscribed the name 37 of the deceased (FIG. 1).

Figure 2:
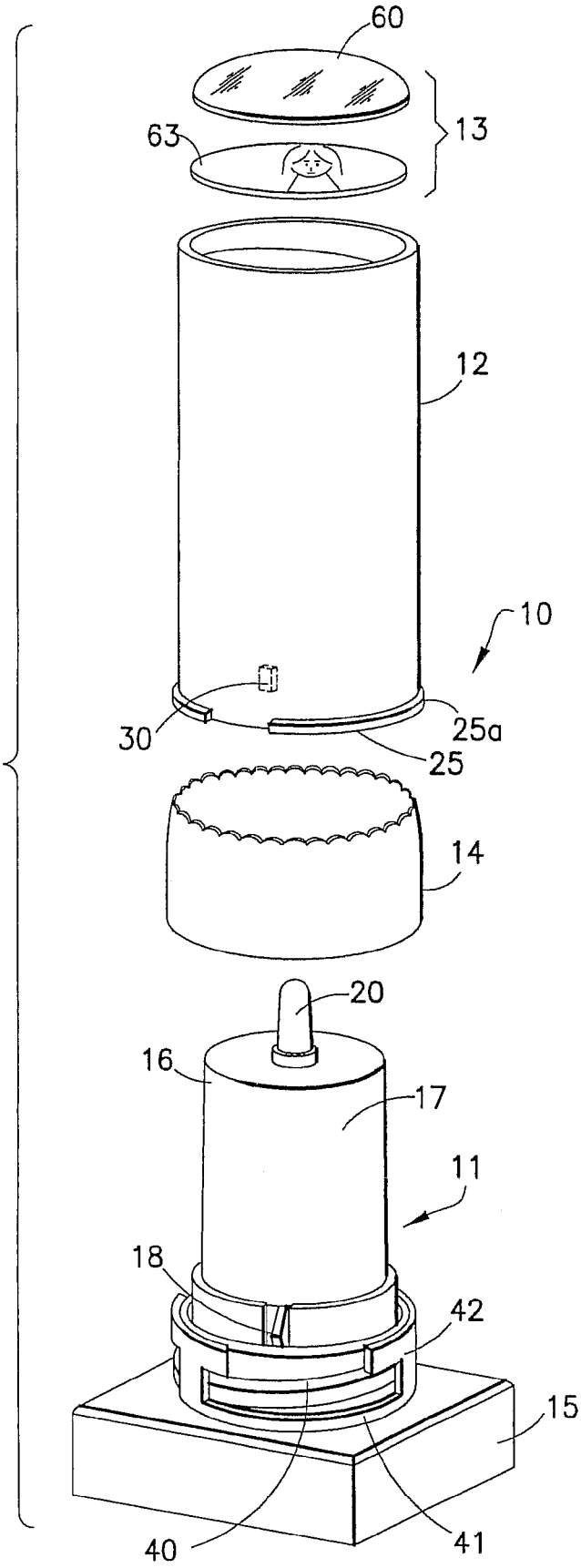
FIG. 2 is an exploded enlarged assembly view of the electronic candle of FIG. 1.

Further, referring to FIGS. 2 and 3A, candle cover sleeve 12 top assembly 13 includes a transparent cover or magnifying lens 60, and a photo 63 of the deceased. The photo is shaped that it will fit into recess 22B. The inside upper portion of candle cover sleeve 12 with its lowered and angled circular top 22A and its recess 22B will receive photo and the photo will be held and protected by lens cover 60 by pressing it in to candle cover sleeve top.

Figure 5:
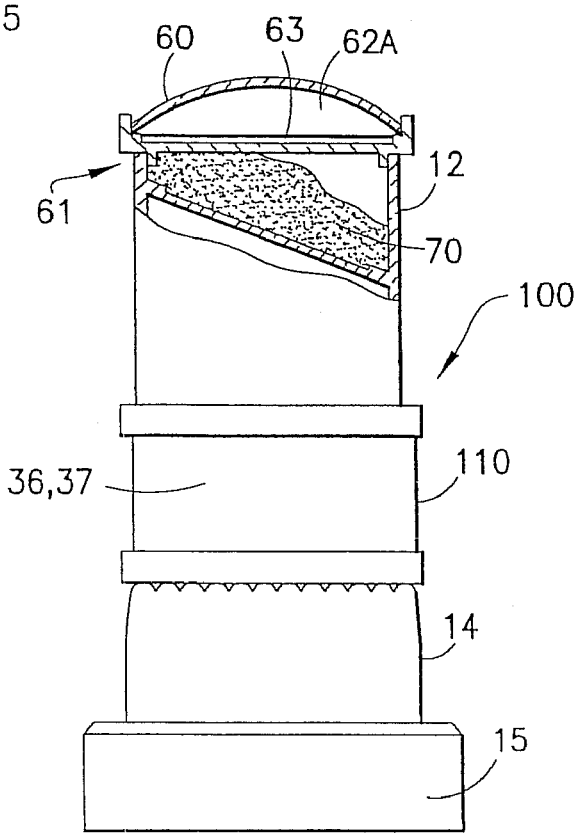
FIG. 5 is a side elevational and sectional view of a further embodiment of the electronic candle as shown in FIG. 4. A sheet indicia bearing collar is added to FIG. 4.
Figure 4:
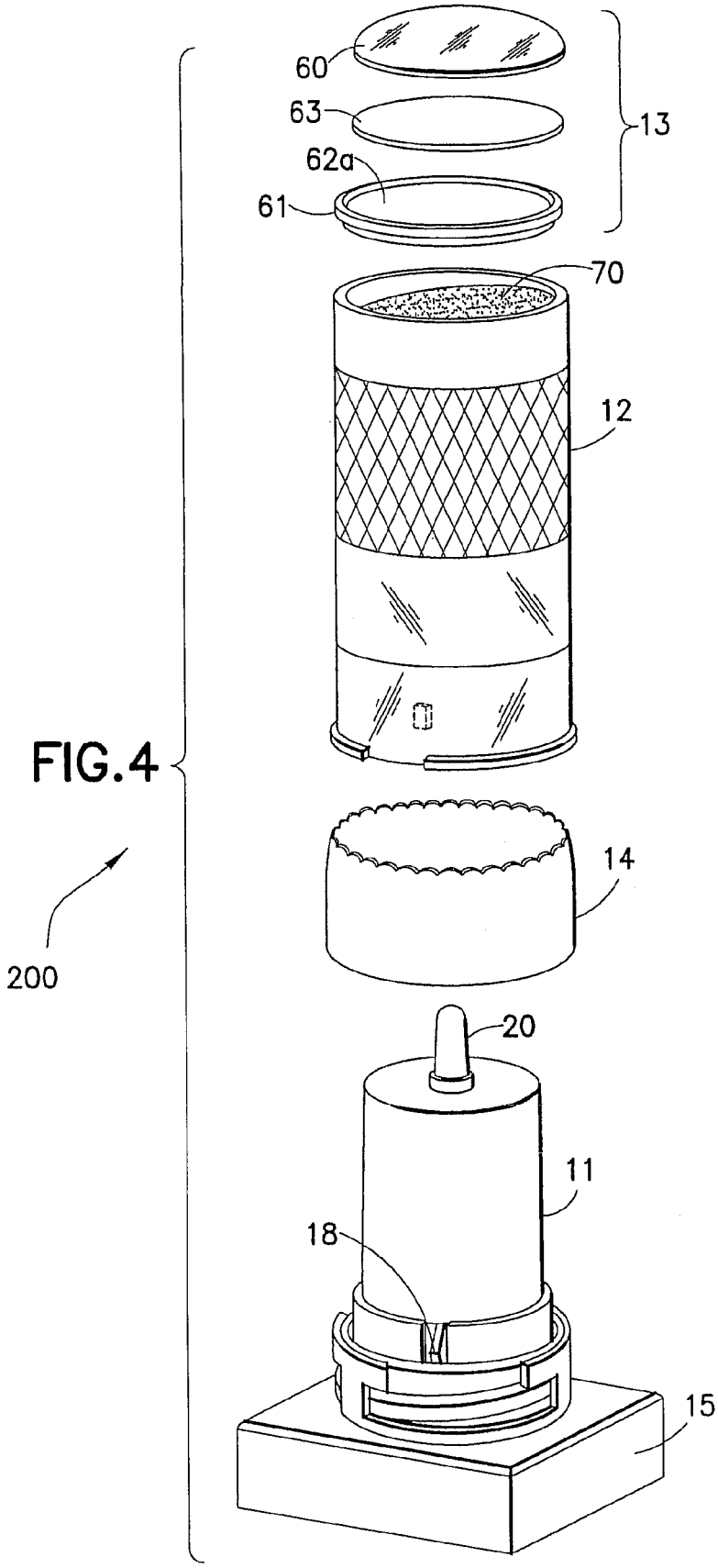
FIG. 4 in a view as shown in FIG. 2 showing a further embodiment of the electronic candle with a compartment space or chamber in candle cover sleeve.

Referring to FIGS. 4 and 5, there is shown a further embodiment of the electronic candle 10 customization. With transparent plate or insert 61 having recess 62A in its upper top surface closing the candle cover sleeve at top edge 24 a chamber or compartment 70 can be created with a slanted bottom toward the front. The compartment or chamber 70 may be used to stow or preserve a memento (not shown) or significance to the customer or viewer. The transparent insert 61 may receives a picture in its recess 62A that is covered with lens 60. The inserted object will be visible from the front and side from the upper clear section of candle cover sleeve 12.

Referring to FIGS. 10-12A, there are shown alternative embodiments of candle cover sleeve 12, namely 80, 90 and 100. All embodiments of candle cover sleeve 12 are thermoformed or injection molded with same dye but with different inserts (nothing, Cross, Star of David, etc.) to the dye for the different insignias. Also the candle cover sleeves can be molded in various colors to enhance the significant of the insignias. Candle cover sleeve 80 is of molded thermoplastic construction like candle cover sleeve 12. Candle cover sleeve 80 differs from candle cover sleeve 12 in three principal aspects. Candle cover sleeve 80 is formed with a Cross 81 molded and formed as part of the unitary candle cover sleeve construction. Candle cover sleeve 80 is formed of red colored thermoplastic construction. Candle cover sleeve 80 is also formed of an upper inner surface, which is textured 84. Texture surface "breaks up" the flickering light emanating from the colored LEDs 19 to provide an enhanced simulated flickering wax candle effect. Candle cover sleeve 90 is formed or molded with a Star of David 91. Candle cover sleeve 90 is formed of a deep blue colored thermoplastic construction. The upper inner surface of candle cover sleeve 90 is textured (not shown in FIG. 12) in a manner similar to that of candle cover sleeve 80. The LEDs utilized with candle cover sleeve 90 are complementarily colored to provide an enhanced simulated wax candle flickering effect. Candle cover sleeve 100 represents when customer wants no religious designation of candle. It has the same construction than the candles with insignias.

The following Table I shows a coordination of the textured candle cover sleeve colors, the LED colors and their required voltage provided by the DC/DC converter 52 to cause the respective enhanced simulated wax candle flickering effects.

TABLE I

| Sleeve Color | LED color | Voltage (v) |
|---|---|---|
| Red | Red | 1.9; |
| Blue | Blue | 3.1; |
| Clear | Yellow | 2.1; and |
| Green | Green | 3.4. |

Figure 6:
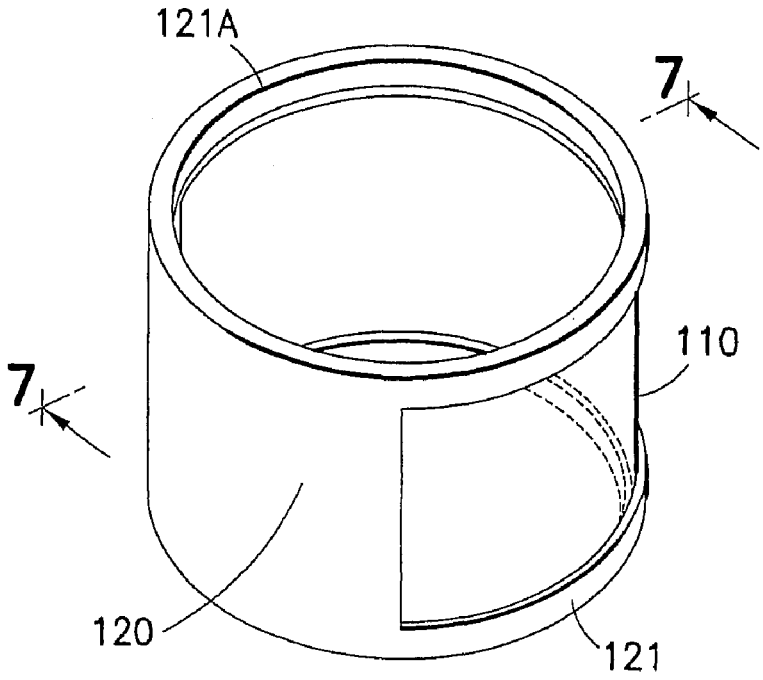
FIG. 6 is an enlarged perspective view of the collar of FIG. 5.
Figure 7:
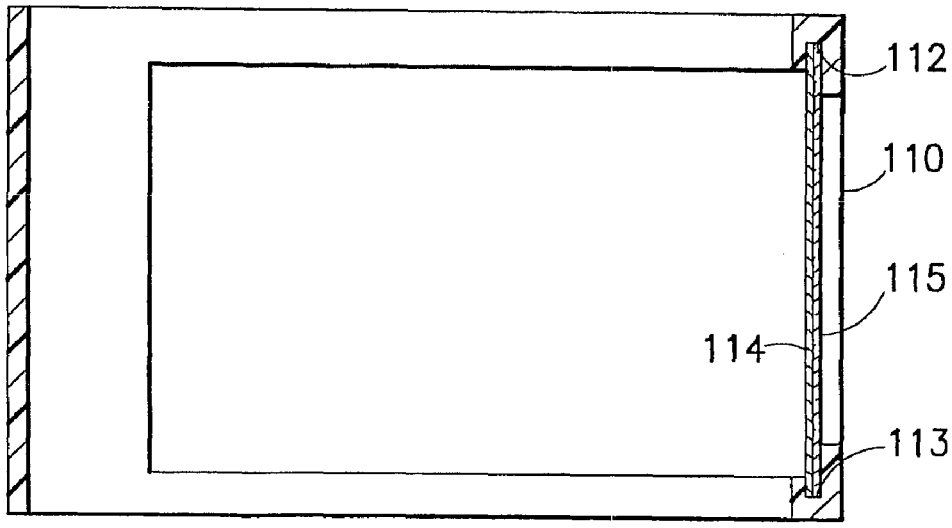
FIG. 7 is an enlarged sectional view of the collar taken along line 7-7 of FIG. 6.

Referring to FIGS. 5-7, there is shown an alternate embodiment candle 100. Candle 100 differs from candle 10 that candle 100 does not include memorial elements 36, 37, and 35. Candle 100 is constructed with a partially open external memorial collar assembly 110. Collar assembly 110 is slidably disposed on the outer surface of the candle cover sleeve 12 and rests on cover 14. Collar assembly 110 is formed of 2 rings of 121 and 121A and a cylindrical segment of 120. Upper and lower inner recesses 112 and 113 are formed in ring 121 and 121A. Indicia bearing sheet 114 of paper or thermoplastic, which is imprinted with the memorial indicia 36 and 37, is removably disposed in recesses 112 and 113. A protective transparent plastic cover sheet 115 is disposed in recesses 112 and 113 in front of sheet 114 and functionally retained in recess 112-113. FIG. 6 shows a perspective view of collar 110 and FIG. 7 is a sectional view of collar 110 at axis 7-7. Candle 100 may include any of the candle cover sleeve configuration.

The afore-discussed embodiments provide a readily customized memorial candle for funerary and memorial businesses. One method, by way of example, useful in a funerary business is where a loved one of the deceased completes an e-form that with the Internet instructs the funeral director as to e.g. the name, religion and image of the decease. The funeral director that imprints the requested memorial information 36 and 37 and photo and assembles the candle with the appropriate candle cover sleeves e.g. 80 or 90 or 100 or any other and complementary LEDs (Table I). This construction and methodology permits a readily customized and personalized electronic candle, which stimulates a flickering lighted wax candle in perpetuity.

Figure 13:
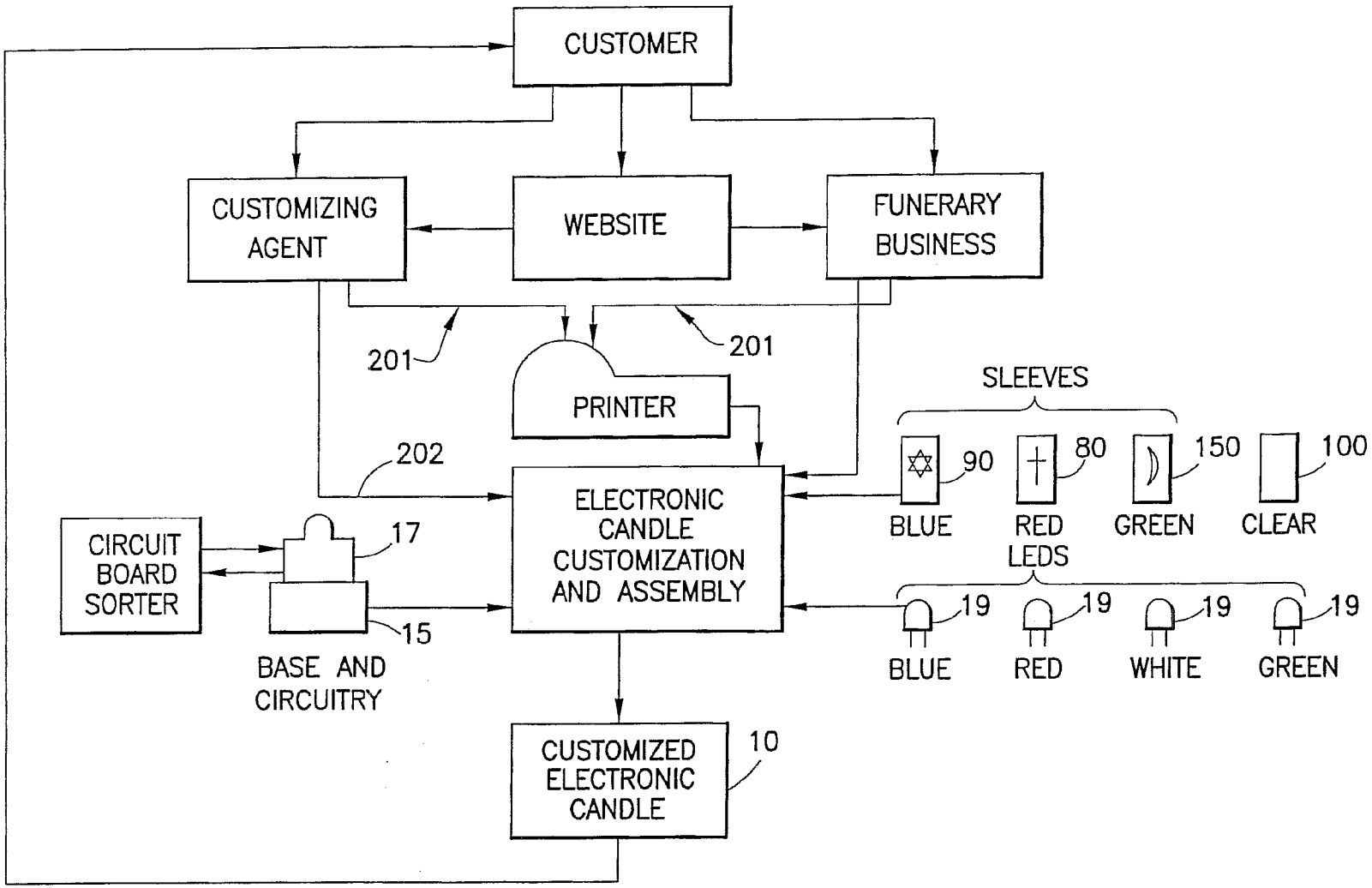
FIG. 13 is a schematic showing the business method and system of the present invention.

A business, such as a funerary or memorial business, may utilize the afore-discussed electronic candle construction to provide cost-effective personalization and customization services to diverse customers. In one preferred embodiment of the business; (a) an e-form is provided by the business on the business website; (b) a prospective customer accesses the website and completes the e-form, including information such as (i) name of deceased; (ii) religion of deceased and (iii) photograph of the deceased; (c) the business then assembles the appropriate symbol bearing candle cover sleeve (colors), LEDs and memorial indicia and simultaneously bills the customer's credit card (FIG. 13). The funerary business or customizing agent may transfer the indicia and customization instructions 201 to a printer and the memento 202 to the assembly location where the electronic candle is assembled (FIG. 13). The customer is then provided with the customized and personalized electronic candle at or in connection with a funeral or memorial service.

The described systems and candle 10 constructions provides a simulated flame lighted in perpetuity, with readily viewable memorial indicia 37, memorial photo and/or memorial memento. The present invention provides a complete all-in-one customized and personalized memorial unit.

The above-discussed specific embodiments are not intended to be limiting in any way. Many changes can be made to the invention without departing from the scope thereof. It is intended that all material contained herein be interpreted as illustrative of the invention and not in a limiting sense of the invention which is defined by the adjoined claims

What is claimed:

1. A business method for customizing an electronic candle system comprising:

(a) providing a customization system for a funerary or memorial business, said customization system comprises:

(i) an electronic candle assembly comprising an illumination element and means for illuminating the illumination element for providing a simulated illuminated wax candle effect;

(ii) a first candle cover sleeve comprising a translucent upper portion and first customizing indicia;

(iii) a second candle cover sleeve comprising a translucent upper portion and second customizing indicia, said second indicia being visually distinguishable from said first indicia; and wherein said assembly and each said candle cover sleeve comprise cooperable means for selective alternate assembly of each said cover sleeve to the electronic candle assembly; and (b) selecting one of the sleeves for customization for a specific funerary or memorial business customer; and (c) assembling the selected sleeve to the electronic candle assembly;

whereby the electronic candle is customized.

2. The business method of claim 1, further comprising prior to step (b), the customer (b') providing an order for customization to the business.

3. The business method of claim 2, wherein the business operator is a funeral director, and the customer is customizing the electronic candle for the deceased.

4. The business method of claim 3, said first sleeve comprises a blue color and the first indicia comprises a Star of David, and the second sleeve comprises a red color and the second indicia comprises a Cross.

5. The business method of claim 1, wherein each indicia comprises a respective religious symbol.

6. The business method of claim 1, each said sleeve comprises an accessible and viewable compartment for receiving a memento of significance to the funerary or memorial business customer.

7. The business method of claim 1, said electronic candle illumination assembly comprises means for illumination effectively in perpetuity.

8. The business method of claim 6, said compartment comprises a convex lens for enhanced viewing of the memento.

9. The business method of claim 6, further comprising imprinting the name of the deceased on the memento.

10. The business method of claim 1, said assembly comprises a base having a switch arm for actuating the illumination element, each sleeve comprises means for operably engaging the switch arm during step (c) to illuminate the illumination element.

11. The business method of claim 2, wherein step (b) is via a website.

12. The business method of claim 2, wherein step (b') is via a website.

13. The business method of claim 1, wherein step (c) is performed by the business.

14. The business method of claim 13, further comprising after step (c), (d) the business billing the customer via a website for the customized electronic candle.

15. A business method for customizing an electronic candle system comprising:

(a) providing a customization system for an electronic candle, said customization system comprises (i) an electronic candle assembly comprising an illumination element and means for illuminating the illumination element for providing a simulated illuminated wax candle effect;

(ii) a first candle cover sleeve comprising a translucent portion and at least one of a first customizing indicia and first customizing color;

(iii) a second candle cover sleeve comprising a translucent portion and at least one of a second customizing indicia and second customizing color, said second indicia and color being visually distinguishable from said first indicia and color; and wherein said assembly and each said candle cover sleeve comprise cooperable means for selective alternate assembly of each said sleeve to the electronic candle assembly;

(b) selecting one of the sleeves for customizing by a customer, and further comprising;

(c) assembling the selected sleeve to the electronic candle assembly to customize the electronic candle.

16. The business method of claim 15, further comprising prior to step (b) providing an order for said electronic candle.

17. The method of claim 15, said first color comprises a blue color and the first indicia comprises a Star of David, and the second color comprises a red color and the second indicia comprises a Cross.

18. The method of claim 15, wherein each indicia comprises a respective religious symbol.

19. The method of claim 15, each said sleeve comprises an accessible and viewable compartment for receiving a memento of significance to the customer.

20. The method of claim 15, said electronic candle illumination assembly comprises means for pending illumination effectively in perpetuity.

21. The method of claim 19, said compartment comprises a convex lens for enhanced viewing of the memento.

22. The method of claim 15, further comprising imprinting information on the sleeves.

23. The method of claim 15, further comprising imprinting a first design and first color on the first sleeve and a second design and second color on the second sleeve.

24. The method of claim 15, said assembly comprises a base having a switch arm for actuating the illumination element, each sleeve comprises means for operably engaging the switch arm during step (c), whereby the illumination element is illuminated with the downward movement of the sleeve.

25. The method of claim 15, each said translucent portion comprises an upper portion of the sleeve wherein the illumination passes through the translucent portion and illuminates the selected color and indicia.

26. The method of claim 15, wherein each sleeve is cylindrical and the base is cylindrical.

27. The method of claim 15, said assembly comprises a slot, each said cover sleeve being selectively slidably disposed in the slot to actuate the means for illuminating the illumination element.

28. The method of claim 27, said method further comprises; (d) downwardly moving the selected cover sleeve in the slot to contactingly engage the means for illuminating the illumination element to provide the simulated wax candle effect that is visible through the translucent portion of the cover sleeve.

29. The method of claim 28, said means for illuminating the illumination element comprises a switch arm operably disposed in the slot.

30. The method of claim 29, said assembly further comprises a spring operably connected to the switch arm for return of the switch arm to an non-illuminating position with the upward removal of the sleeve from the slot.

31. The method of claim 30, said first sleeve comprises a first design and said second sleeve comprises a second design, and wherein the customer customizes the electronic candle by selecting one of the first or second sleeves.

32. The method of claim 31, wherein step (a) is performed by the business, and steps (b) and (c) are performed by the customer.

* * * * *